US007720411B2

(12) United States Patent
Itabashi

(10) Patent No.: US 7,720,411 B2
(45) Date of Patent: May 18, 2010

(54) IMAGE FORMING APPARATUS

(75) Inventor: Nao Itabashi, Nagoya (JP)

(73) Assignee: Brother Kogyo Kabuhsiki Kaisha, Nagoya-shi, Aichi-ken (JP)

( * ) Notice: Subject to any disclaimer, the term of this patent is extended or adjusted under 35 U.S.C. 154(b) by 291 days.

(21) Appl. No.: 12/042,057

(22) Filed: Mar. 4, 2008

(65) Prior Publication Data

US 2008/0219696 A1 Sep. 11, 2008

(30) Foreign Application Priority Data

Mar. 9, 2007 (JP) ..... 2007-060034

(51) Int. Cl.
*G03G 15/00* (2006.01)

(52) U.S. Cl. ..... 399/110; 399/113; 399/114

(58) Field of Classification Search ..... 399/107, 399/110–114, 116, 117, 118
See application file for complete search history.

(56) References Cited

U.S. PATENT DOCUMENTS 7,362,987 B2 * 4/2008 Nishimura ..... 399/112
7,388,593 B2 * 6/2008 Fukuda ..... 347/138
7,486,909 B2 * 2/2009 Sato et al. ..... 399/110
2006/0050135 A1 3/2006 Fukuda
2006/0067734 A1 3/2006 Igarashi

FOREIGN PATENT DOCUMENTS

JP 2006078542 A 3/2006
JP 2006098772 A 4/2006

* cited by examiner

*Primary Examiner*—Hoan Tran
(74) *Attorney, Agent, or Firm*—Banner & Witcoff, Ltd.

(57) ABSTRACT

An image forming apparatus includes an apparatus body, a holding member and a supporting member coupled to the holding member. The holding member includes photosensitive drums and is configured to hold toner cartridges disposed in association with the photosensitive drums in a detachable manner and to move between a storage position in which the holding member is accommodated in the apparatus body and a replacement position. The supporting member is configured to support light source arrays in association with the photosensitive drums, to cover the holding member, to move between a retaining position where the light source arrays are positioned relative to the photosensitive drums and a withdrawn position where the light source arrays are withdrawn from the photosensitive drums, and to move to the withdrawn position in a different direction than the direction in which the holding member is moved to the replacement position.

16 Claims, 10 Drawing Sheets

IMAGE FORMING APPARATUS

CROSS REFERENCE TO RELATED APPLICATION

This application claims priority from Japanese Patent Application No. 2007-060034, filed on Mar. 9, 2007, the entire subject matter of which is incorporated herein by reference.

FIELD

Aspects of the invention relate to image forming apparatuses such as electrophotographic printers and copiers.

BACKGROUND

A known image forming apparatus, e.g. an electrophotographic printer or copier, generally uses a light-emitting diode (LED) head array for exposing a photoconductive drum to light.

The LED head array is mounted on an inner side of a lid or top cover pivotally mounted to the top of a body of the image forming apparatus. When the lid is positioned at an open position, the LED head array is separated from the photosensitive drum of a process cartridge disposed in the body of the apparatus.

In the image forming apparatus, a toner cartridge is installed in a process cartridge. When the toner cartridge is replaced with a new one, the top cover should be opened so as to prevent the toner cartridge and the LED head array from interfering with each other.

However, to open the top cover, sufficient space is required above the image forming apparatus. If such space is not available, replacement of the toner cartridge can be difficult.

SUMMARY

Aspects of the invention provide an image forming apparatus configured to facilitate toner cartridge replacement even if sufficient space is not available above the image forming apparatus.

BRIEF DESCRIPTION OF THE DRAWINGS

Illustrative aspects of the invention will be described in detail with reference to the following figures in which like elements are labeled with like numbers and in which.

DETAILED DESCRIPTION

An illustrative embodiment of the invention will be described in detail with reference to the accompanying drawings. An image forming apparatus according to aspects of the invention may be a multifunction printer (MFP) having a copier function, printer function, scanner function and facsimile function. It will be appreciated that aspects of the invention apply to other types of image forming apparatuses as well.

Figure 1:
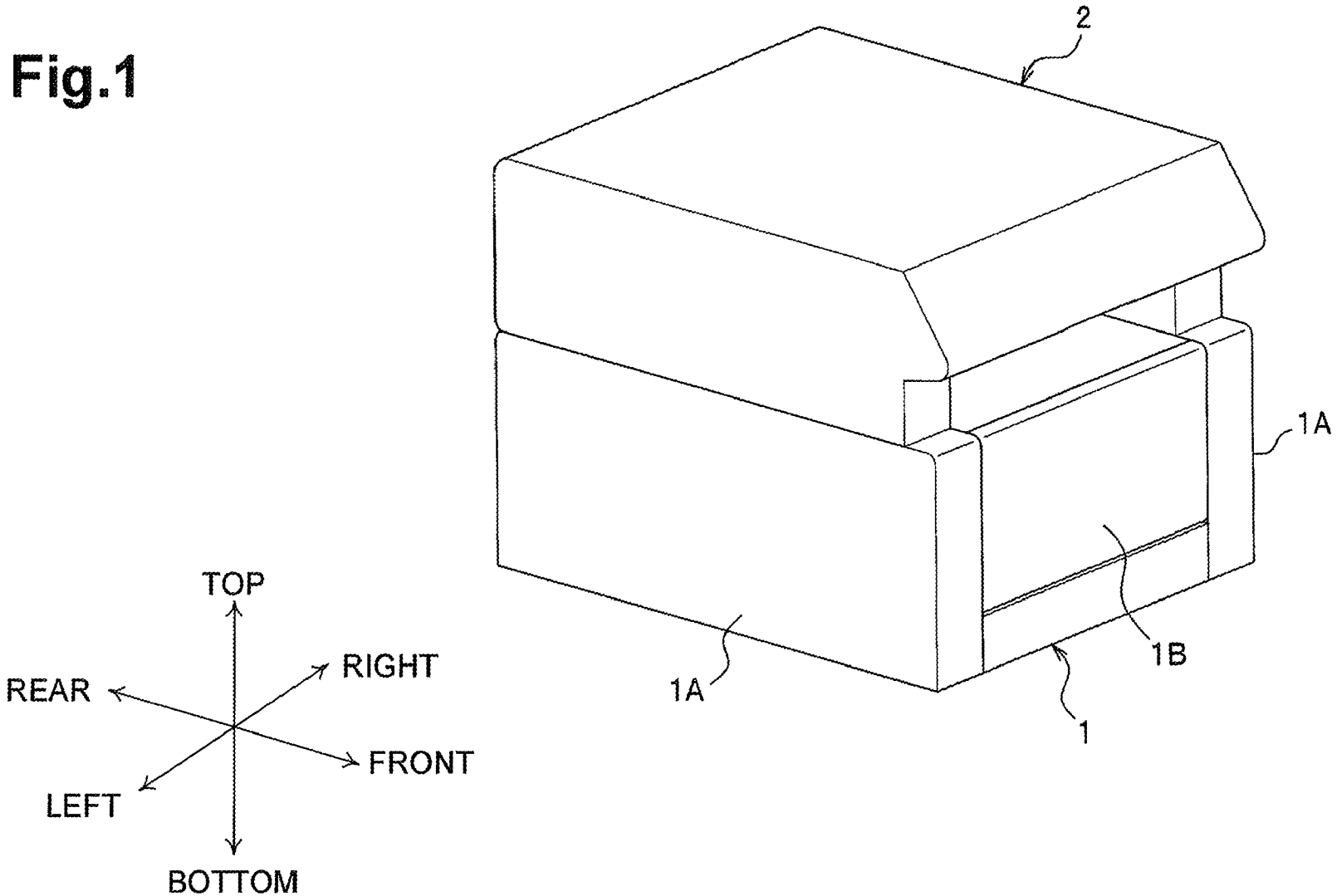
FIG. 1 is a perspective view of an appearance of an image forming apparatus according to an illustrative embodiment of the invention.

As shown in FIG. 1, an apparatus body 1 of the image forming apparatus includes side covers 1A, a front cover 1B, and a large-sized top cover 2. The top cover 2 can become heavy when it contains a scanner and an automatic document feeder, which are not shown.

For ease of discussion, in the following description, the top or upper side, the bottom or lower side, the left or left side, the right or right side, the front or front side, and the rear or rear side of the image forming apparatus will be identified as indicated by the arrows in FIG. 1. The sides of the image forming apparatus according to the illustrative embodiment will be referenced as viewed from a vantage point in front of the image forming apparatus. Sides of individual objects of the image forming apparatus will be similarly identified based on the arranged/attached position of the object on/in the image forming apparatus in FIG. 1.

Figure 2B:
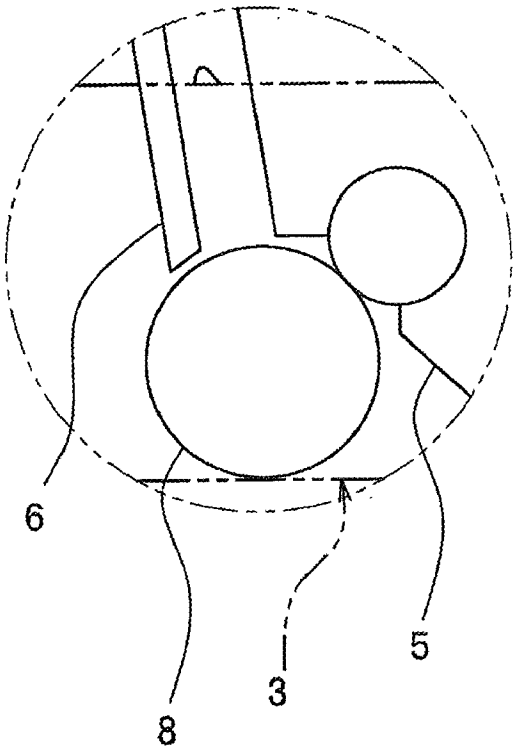
FIG. 2B is an enlarged sectional view showing an X portion of FIG. 2A.
Figure 2A:
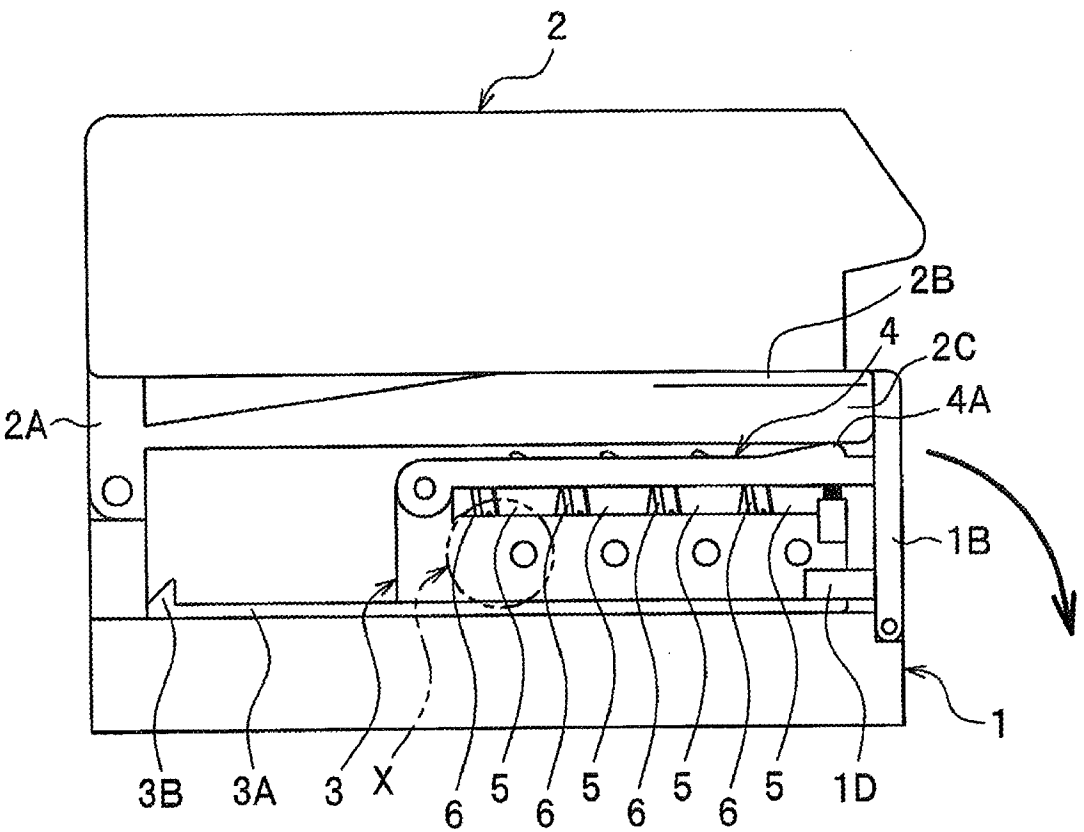
FIG. 2A is an side sectional view of an internal structure of the image forming apparatus of FIG. 1 in which a side cover is eliminated.
Figure 3:
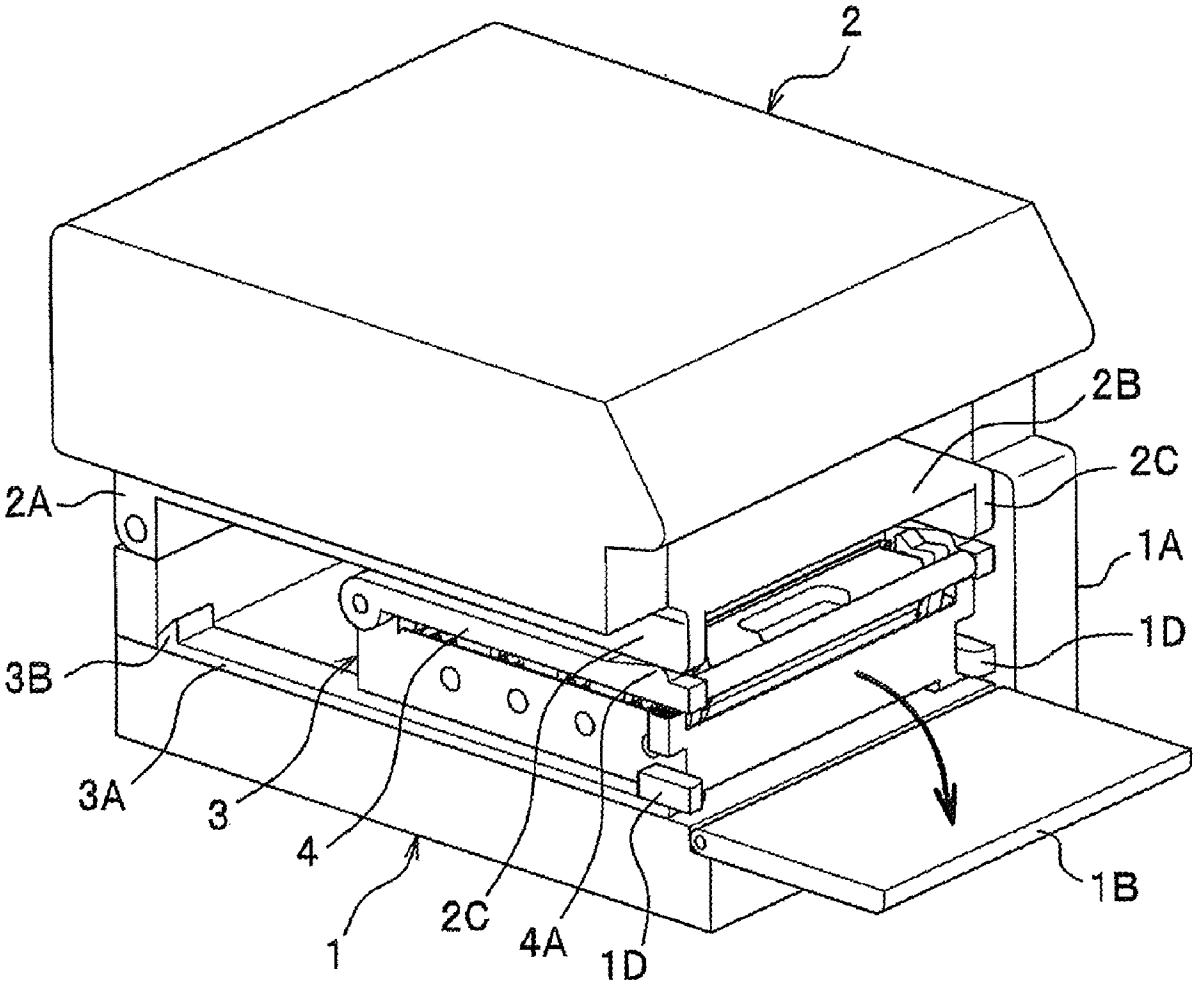
FIG. 3 is a perspective view of the image forming apparatus where the side cover is eliminated and a front cover is opened.

As shown in FIGS. 2A and 3, the front cover 1B is pivotally mounted at its lower end to the apparatus body 1 such that the front cover 1B moves between a closed position where the front cover 1B stands in an upright position to an open position where the front cover 1B protrudes frontward substantially horizontally. The front of the apparatus body 1 is opened and closed by the front cover 1B. A cartridge holding member 3 and an LED supporting member 4 are accommodated in the apparatus body 1.

The top cover 2 includes a support arm 2A protruding downward at a rear end. The support arm 2A is pivotally mounted to an upper end of a rear wall of the apparatus body 1, so that the top cover 2 is released upward. The support arm 2*a* includes a cover portion 2B extending to the front of the apparatus body 1 to cover the cartridge member 3 and the LED supporting member 4.

Figure 4:
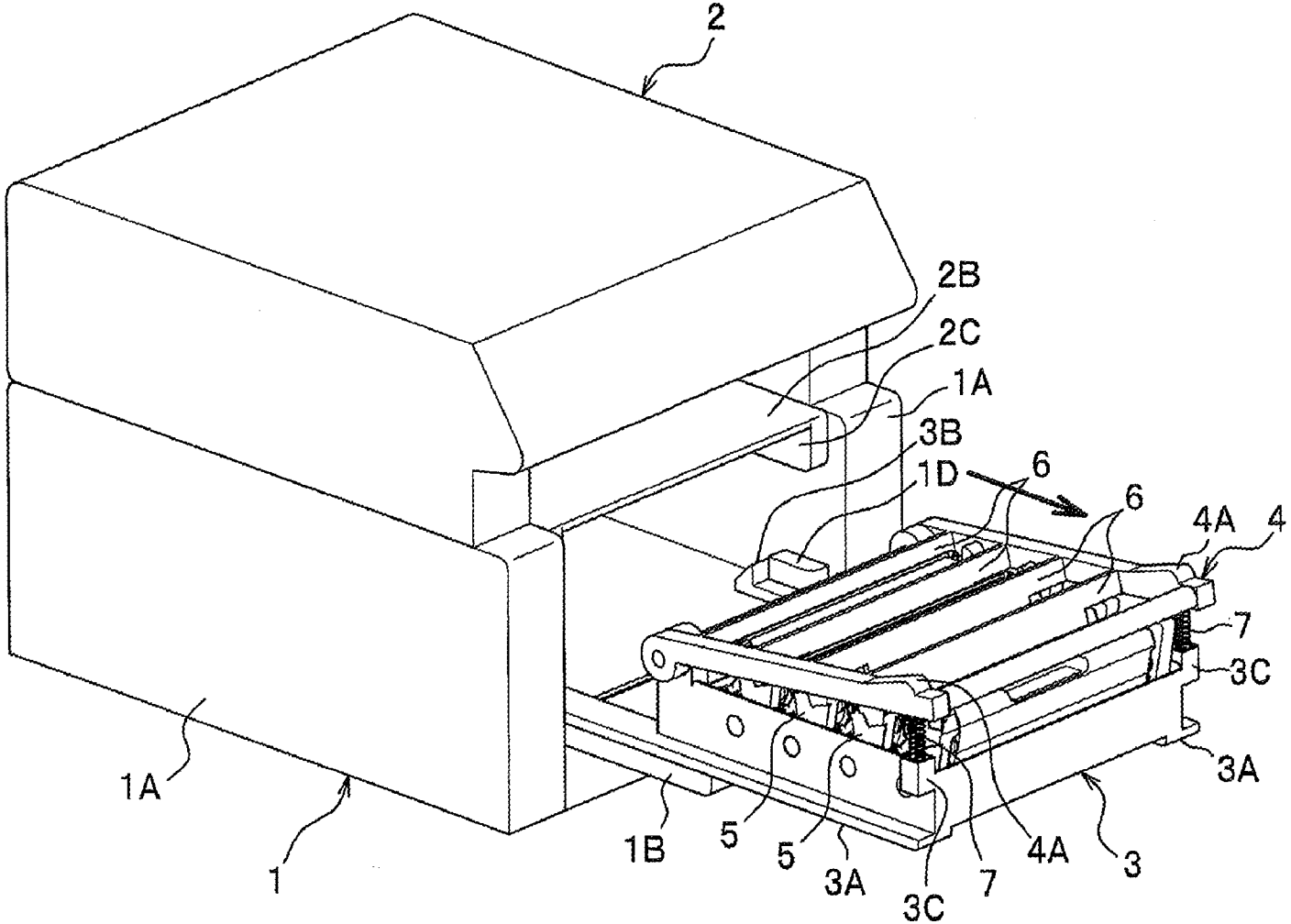
FIG. 4 is a perspective view of the image forming apparatus where a cartridge holding member is pulled out from a body of the image forming apparatus from its storage position to a replacement position along with an LED supporting member.
Figure 5:
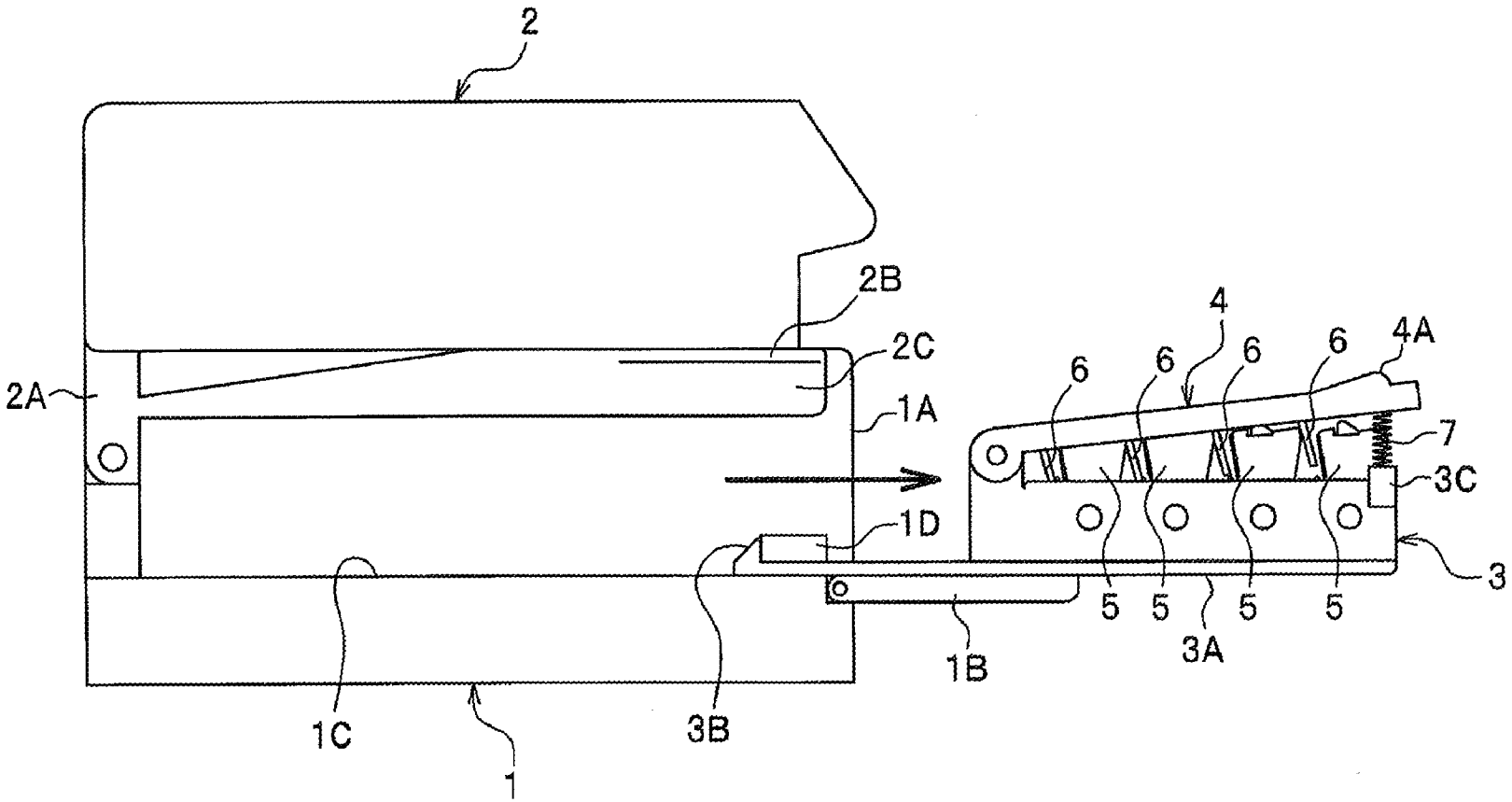
FIG. 5 is a side sectional view of the image forming apparatus of FIG. 4.

As shown in FIGS. 4 and 5, the cartridge holding member 3 can be open-top box-shaped. A pair of slide rails 3A is formed under the cartridge holding member 3. The cartridge holding member 3 is configured to slide on a surface 1C and the front cover 1B positioned in the open position via the slide rails 3A in the front and rear directions.

The slide rails 3A protrude rearward from the rear wall of the cartridge holding member 3, and are formed with engaging portions 3B protruding upward at rear ends. Stoppers 1D are formed on the inner surfaces of the side covers 1A on the left and right sides of the apparatus body 1. The stoppers 1D are configured to catch the engaging portions 3B respectively.

Thus, the cartridge holding member 3 is drawable from a storage position where it is accommodated in the apparatus body 1 as shown in FIGS. 2A and 3 to a replacement position as shown in FIGS. 4 and 5. The cartridge holding member 3 can hold four toner cartridges 5 (FIG. 6) and corresponding photosensitive drums 8 (FIG. 2B) which are arranged in the front-rear direction. The toner cartridges 5 are detachable from the cartridge holding member 3.

Figure 6:
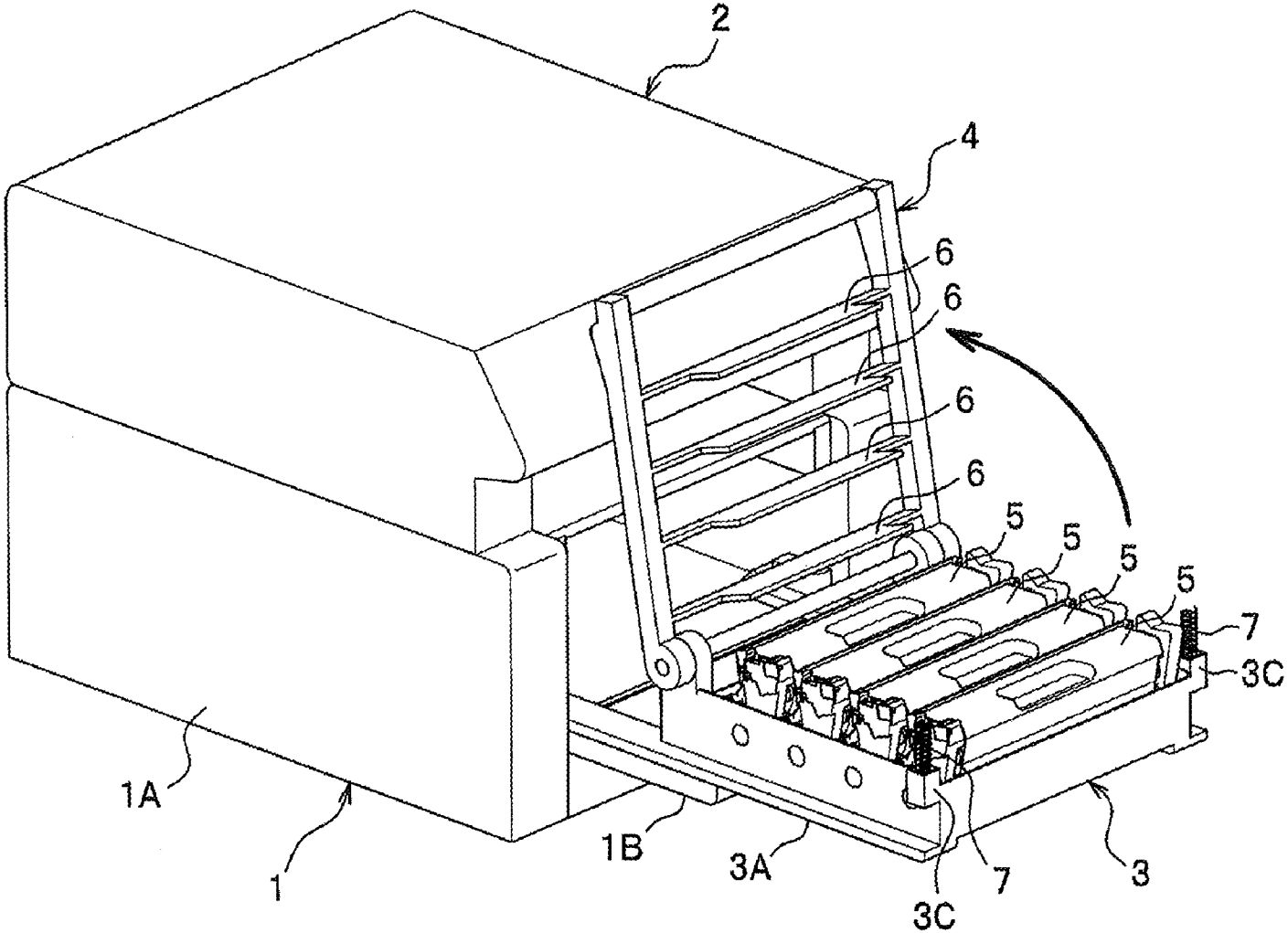
FIG. 6 is a perspective view of the image forming apparatus where the LED supporting member of FIG. 4 is moved from a retaining position to a withdrawn position.
Figure 7:
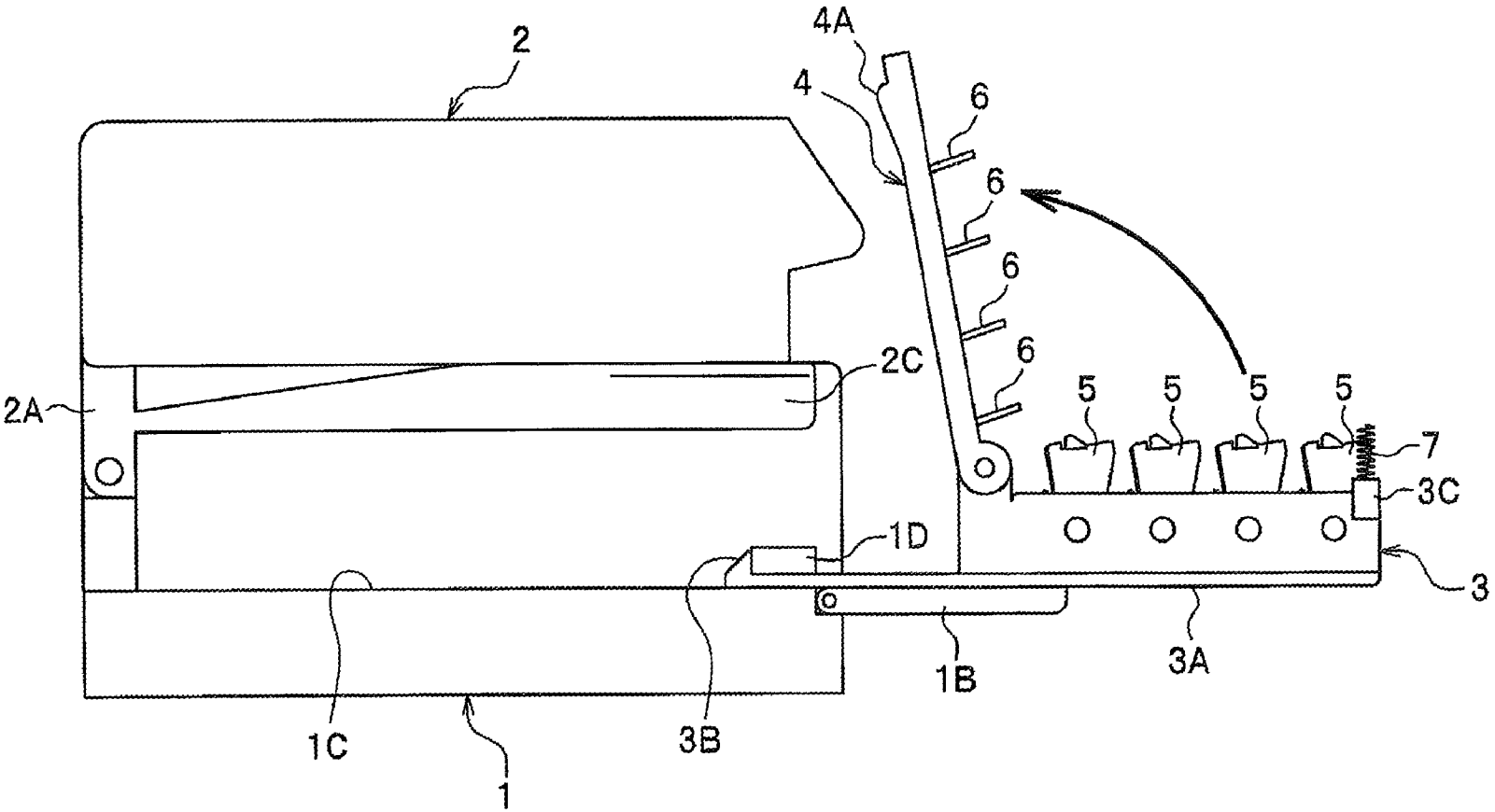
FIG. 7 is a side sectional view of the image forming apparatus of FIG. 6.

The LED supporting member 4 can be a frame-like member covering the cartridge holding member 3 from above. In this instance, the LED supporting member 4 is pivotally connected to the cartridge holding member 3 at the rear end. The LED supporting member 4 is pivotally movable from a retaining position shown in FIG. 2A where each LED head array 6 is positioned relative to the corresponding photosensitive drum 8 to a withdrawn position as shown in FIG. 7 where each LED head array 6 is withdrawn from the corresponding photosensitive drum 8. At the withdrawn position, the LED supporting member 4 is maintained by a stopper, not shown, so that it stands slightly leaning rearward as shown in FIGS. 6 and 7. At this time, toner cartridges 5 received in the cartridge holding member 3 can be replaced.

The LED supporting member 4 supports four LED head arrays 6 arranged in association with the four photosensitive drums 8 mounted in the cartridge holding member 3. The LED head arrays 6 are configured to expose the corresponding photosensitive drums 8 to light.

As shown in FIGS. 4 and 5, a pair of coil springs 7 is disposed at the front end of the cartridge holding member 3. The coil springs 7 are fixed at their lower ends to a pair of bearing portions 3C. When the cartridge holding member 3 is pulled out of the apparatus body 1 to the replacement position, the coil springs 7 resiliently maintain the LED supporting member 4 at a temporary stop position where the LED supporting member 4 is positioned slightly upward from the retaining position, that is positioned immediately before the retaining position.

Cam portions 4A are formed on front left and right sides of the upper surface of the LED supporting member 4 as shown in FIG. 4. The cam portions 4A protrude upward from the LED supporting member 4. The cam portions 4A are configured to cause the LED supporting member 4 to slide down from the temporary stop position to the retaining position while the cartridge holding member 3 is pushed into the storage position as shown in FIG. 2A from the replacement position as shown in FIG. 5.

As shown in FIG. 3, cam contact portions 2C are formed on left and right sides of the cover portion 2B of the top cover 2. The cam contact portions 2C protrude downward from the left and right sides of the cover portion 2B in association with the cam portions 4A. When the cam portions 4A contact the cam contact portions 2C, the LED supporting member 4 is moved to the retaining position.

For replacement of a toner cartridge 5 detachably mounted in the cartridge holding member 3, the front cover 1B can be tilted frontward to the open position until it protrudes horizontally as shown in FIG. 3. As shown in FIGS. 4 and 5, the cartridge holding member 3 can be pulled out from the apparatus body 1 along with the LED supporting member 4, for example when the front cover 1B is in a horizontal position.

The engaging portions 3B, which are formed at the rear ends of the slide rails 3A of the cartridge holding member 3, are engaged with the stoppers 1D formed on the inner surfaces of the side covers 1A of the apparatus body 1. Thus, the cartridge holding member 3 can be maintained in a replacement position out of the apparatus body 1 while remaining engaged with the apparatus body 1.

When the cartridge holding member 3 is pulled out from the apparatus body 1 to the replacement position, the LED supporting member 4 leans upward to the temporary stop position due to the urging force of the coil springs 7.

As shown in FIGS. 6 and 7, the LED supporting member 4 can be raised in a direction of the arrow until it is maintained in the withdrawn position where it stands leaning slightly rearward. In this state, a toner cartridge 5 detachably mounted in the cartridge holding member 3 can be replaced.

After the replacement of the toner cartridge 5 is finished, the LED supporting member 4 is tilted downward from the withdrawn position as shown in FIGS. 4 and 5. The LED supporting member 4 is resiliently maintained at the temporary stop position where it is tilted slightly upward from the retaining position by the coil springs 7 received in the bearing portions 3C of the cartridge holding member 3. The LED head arrays 6 supported by the LED supporting member 4 are not subjected to impact and thus can avoid being damaged.

As shown in FIGS. 2A and 3, the cartridge holding member 3 is pushed into the storage position in the apparatus body 1 along with the LED supporting member 4. At this time, the cam portions 4A protruding upward from the upper surface of the LED supporting member 4 are brought into contact with the cam contact portions 2C of the top cover 2, and the LED supporting member 4 is moved down to the retaining position against the urging force of the coil springs 7. In this way, the cartridge holding member 3 and the LED holding member 4 are positioned and accommodated in the apparatus body 1.

According to the image forming apparatus, even if a space cannot be found above the image forming apparatus, the toner cartridges 5 can be replaced irrespective of whether the top cover 2 is opened or closed. If the top cover 2 is heavy because a scanner and an automatic document feeder are assembled in the top cover 2, the toner cartridges 5 can be replaced irrespective of whether the top cover 2 is opened or closed.

The LED supporting member 4 is withdrawn in a different direction than the direction in which the cartridge holding member 3 is pulled out. That is, the LED supporting member 4 is withdrawn upward pivotally on the rear end of the cartridge holding member 3. As the LED supporting member 4 is moved out of the way, the toner cartridges 5 can be easily replaced.

When the LED supporting member 4 is lowered from the withdrawn position as shown in FIGS. 4 and 5, it is resiliently maintained at the temporary stop position by the urging force of the coil springs 7 where it is tilted slightly upward from the retaining position. Thus, the LED head arrays 6 can avoid being damaged by impact.

When the cartridge holding member 3 is pushed into the apparatus body 1 to the storage position along with the LED supporting member 4, the LED supporting member 4 is pressed down to the retaining position against the urging force of the coil springs 7. Thus, the LED head arrays 6 of the LED supporting member 4 can be easily and reliably positioned with respect to the corresponding photosensitive drums 8 in the cartridge holding member 3.

Figure 8:
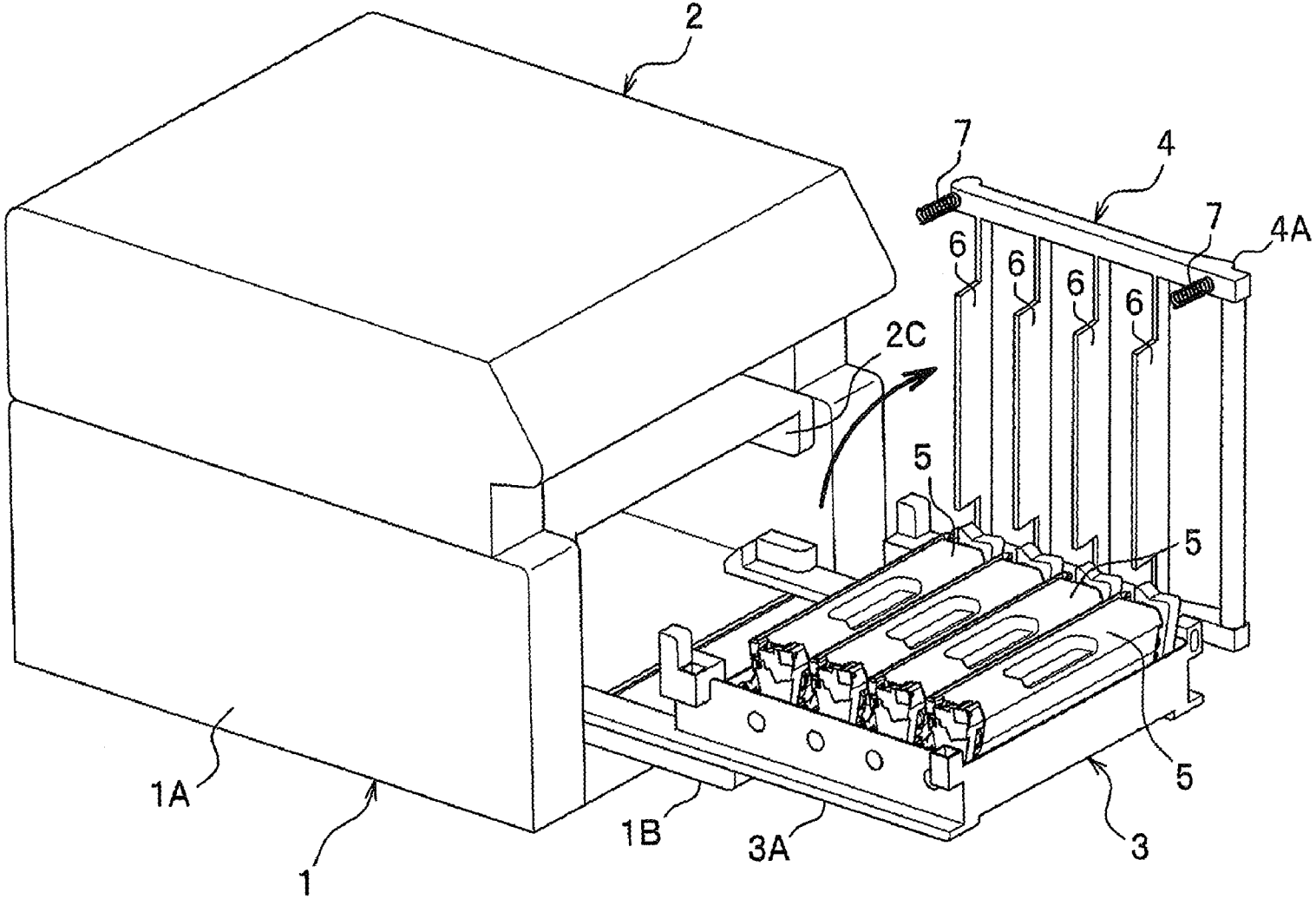
FIG. 8 is a perspective view of an image forming apparatus according to an illustrative embodiment of the invention where an LED supporting member is moved from a retaining position to a withdrawn position.
Figure 9:
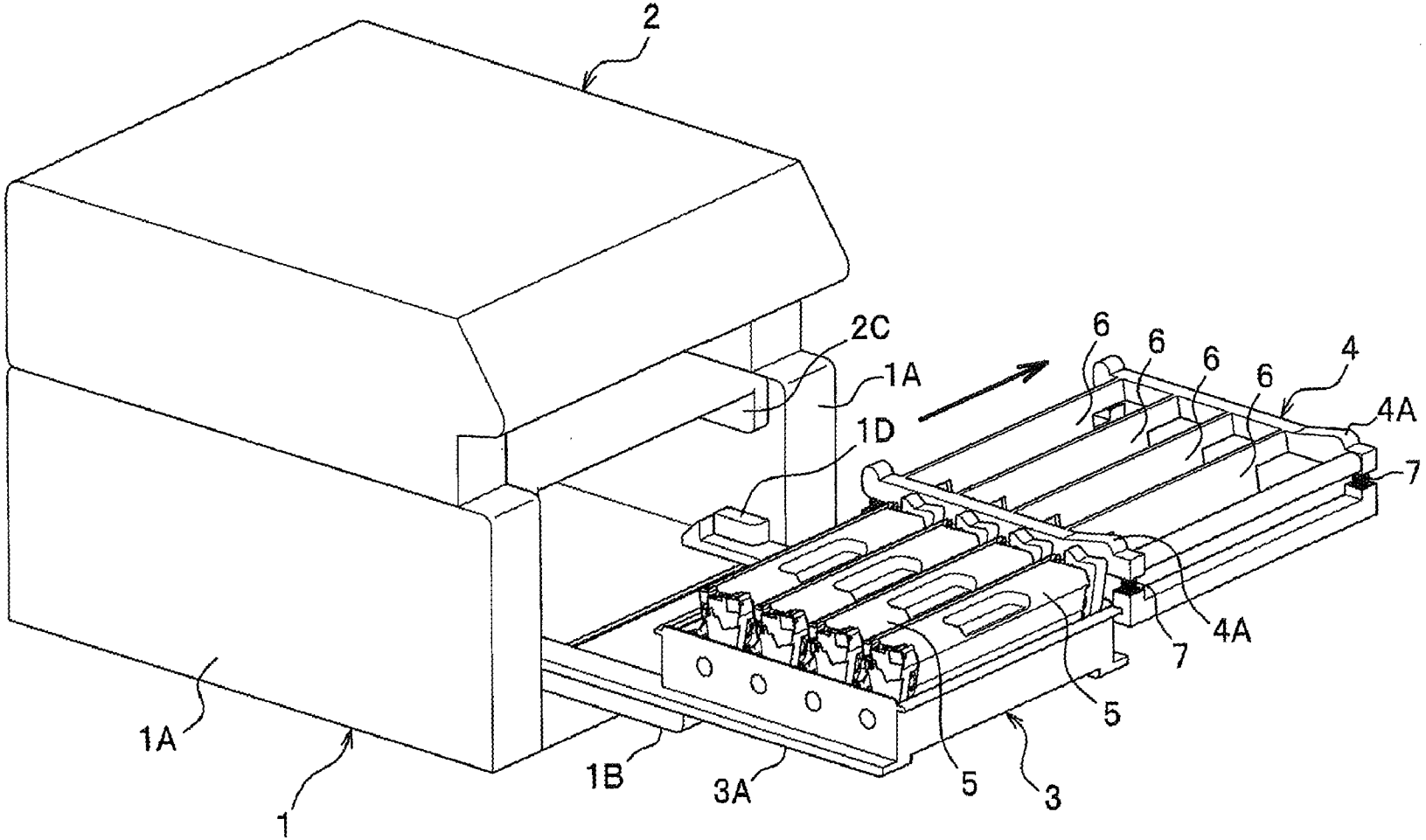
FIG. 9 is a perspective view of another image forming apparatus according to an illustrative embodiment of the invention where an LED supporting member is moved from a retaining position to a withdrawn position.

The image forming apparatus of the invention is not limited to the above embodiment. As shown in FIG. 8, the LED supporting member 4 may be withdrawn in an upward direction pivotally on the right end of the cartridge holding member 3. Alternatively, the LED supporting member 4 may be withdrawn in an upward direction pivotally on the left end of the cartridge holding member 3. As shown in FIG. 9, the LED supporting member 4 may be pulled out rightward from the cartridge holding member 3 with respect to a longitudinal direction of each toner cartridge 5. Alternatively, the LED supporting member 4 may be pulled out leftward from the cartridge holding member 3 with respect to the longitudinal direction of each toner cartridge 5.

The coil springs 7 are used as a temporary stop device that resiliently receives the cartridge holding member 3 in the described illustrative embodiment. The invention is not limited to the coil springs 7. Rubber or leaf spring may be used instead. The coil springs 7 are fixed to the cartridge holding member 3 in the described illustrative embodiment. However, as shown in FIG. 8, the coil springs 7 may be fixed to the LED supporting member 4.

Figure 10:
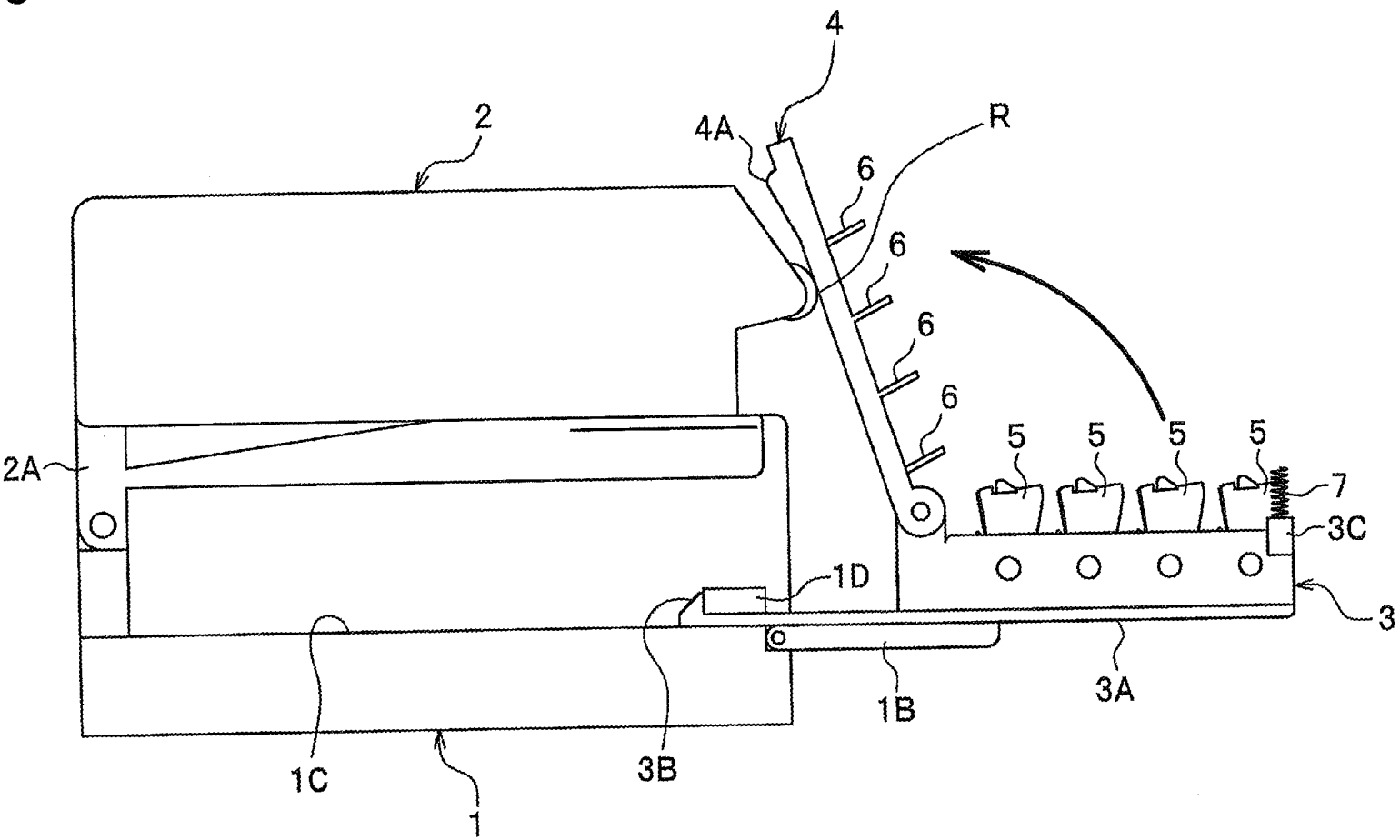
FIG. 10 is a perspective view of an image forming apparatus according to still another illustrative embodiment of the invention where an LED supporting member is moved from a retaining position to a withdrawn position.

In the above configuration to move the LED supporting member 4 pivotally upward toward the apparatus body 1, an elastic member, e.g. rubber R as shown in FIG. 10, may be disposed between the top cover 2 including a scanner and the LED supporting member 4. With the rubber R, if the LED supporting member 4 is thrust open and contacts the top cover 2, the rubber R can absorb the impact generated by the contact. Thus, the scanner in the top cover 2 and the LED head arrays 6 of the LED supporting member 4 can be protected. As shown in FIG. 10, when the LED supporting member 4 contacts the rubber R of the top cover 2, the LED supporting member 4 can be maintained at the withdrawn position by the apparatus body 1 that is heavier in weight than the LED supporting member 4. Thus, the LED supporting member 4 can be stably held at the withdrawn position. The elastic member may include a coil spring and a sponge. The elastic member may be disposed on the top cover 2 or the LED supporting member 4.

In the above illustrative embodiment, the cartridge holding member 3 is inseparable from the apparatus body 1 by engaging the engaging portions 3B of the slide rails 3A with the stoppers 1D of the apparatus body 1. However, the cartridge holding member 3 may be completely separated from the apparatus body 1. Even with this configuration, the LED supporting member 4 may be opened after the cartridge holding member 3 is completely removed from the apparatus body 1, so that toner cartridge 5 can be replaced.

In the above illustrative embodiment, the LED head arrays 6 are used as a light source. Any suitable light source may be used such as an array of organic electroluminescent light emitting elements or fluorescent light emitting elements may be used. To control light amount from the light source, the light emitting elements may emit light selectively according to image data. Alternatively, a plurality of liquid crystal or lead-lanthanum-zirconate-titanate (PLZT) optical shutters may be arranged to selectively control the time to open/close each optical shutter.

While the features herein have been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an apparatus body;

a holding member including a plurality of photosensitive drums, the holding member being configured to hold a plurality of toner cartridges disposed in association with the photosensitive drums in a detachable manner and to move between a storage position in which the holding member is accommodated in the apparatus body and a replacement position; and a supporting member coupled to the holding member, the supporting member being configured to support a plurality of light source arrays in association with the photosensitive drums and to cover the holding member, the supporting member being configured to move between a retaining position where the light source arrays are positioned relative to the photosensitive drums and a withdrawn position where the light source arrays are withdrawn from the photosensitive drums, and the supporting member being configured to move to the withdrawn position in a different direction than the direction in which the holding member is moved to the replacement position.

2. The image forming apparatus according to claim 1, wherein at least one of the holding member and the supporting member includes a stop device configured to hold the supporting member at a position immediately before the retaining position when the holding member is in the replacement position.

3. The image forming apparatus according to claim 2, wherein the stop device comprises a coil spring.

4. The image forming apparatus according to claim 2, wherein the supporting member is pivotally movable with respect to the holding member.

5. The image forming apparatus according to claim 4, wherein a portion of the apparatus body moves the supporting member from the position immediately before the retaining position to the retaining position during movement of the holding member to the storage position.

6. The image forming apparatus according to claim 4, wherein the supporting member is pivotally movable from the retaining position to the withdrawn position in a direction away from the apparatus body.

7. The image forming apparatus according to claim 4, wherein the supporting member is pivotally movable from the retaining position to the withdrawn position in a direction toward the apparatus body.

8. The image forming apparatus according to claim 2, wherein the supporting member is slidably moved with respect to the holding member.

9. The image forming apparatus according to claim 8, wherein a portion of the apparatus body moves the supporting member from the position immediately before the retaining position to the retaining position during movement of the holding member to the storage position.

10. The image forming apparatus according to claim 2, wherein the supporting member includes a cam formed on an upper surface, the cam configured to contact the apparatus and cause the supporting member to move from the position immediately before the retaining position to the retaining position during movement of the holding member to the storage position.

11. The image forming apparatus according to claim 1, further comprising a document reading apparatus disposed above the apparatus body.

12. The image forming apparatus according to claim 11, further including an elastic member, wherein when the holding member is in the replacement position, the supporting member is tilted toward the document reading apparatus and the elastic member is disposed between the supporting member and the document reading apparatus.

13. The image forming apparatus according to claim 12, wherein the elastic member is disposed on the supporting member.

14. The image forming apparatus according to claim 12, wherein the elastic member is disposed on the document reading apparatus.

15. The image forming apparatus according to claim 1, wherein the apparatus body includes a cover which moves between a closed position and an open position, and when the cover is in the open position the holding member being movable between the storage position and the replacement position.

16. The image forming apparatus according to claim 1, wherein the apparatus body includes stoppers and the holding member includes engaging portions, wherein the engaging portions are configured to engage the stoppers when the holding member is moved to the replacement position.

* * * * *